United States Patent [19]

Anderson

[11] Patent Number: 4,962,849

[45] Date of Patent: Oct. 16, 1990

[54] FOOD CONTAINER WITH LID CLOSURE HAVING A STAND FEATURE

[75] Inventor: David S. Anderson, Brooklyn Park, Minn.

[73] Assignee: General Mills, Inc., Minneapolis, Minn.

[21] Appl. No.: 418,425

[22] Filed: Oct. 6, 1989

[51] Int. Cl.[5] ..... B65D 5/52

[52] U.S. Cl. ..... 206/45.24; 206/45.25; 206/467; 206/469; 206/631; 206/633; 229/125.03; 229/125.35

[58] Field of Search ..... 206/45.24, 45.25, 629, 206/631, 633, 461, 467, 469, 470; 229/125.03, 125.35

[56] References Cited

U.S. PATENT DOCUMENTS

| | | | |
|---|---|---|---|
| 1,956,642 | 5/1934 | Einson | 206/45.25 |
| 2,308,396 | 1/1943 | Spruth | 206/45.25 |
| 3,093,244 | 6/1963 | Middleton, Jr. et al. | 206/45.24 |
| 3,717,533 | 2/1973 | Mayworm et al. | 206/633 |
| 3,765,595 | 10/1973 | Bernhardt | 206/631 |
| 4,149,630 | 4/1979 | Tranport | 206/45.24 |
| 4,236,637 | 12/1980 | Castner, Sr. et al. | 206/470 |
| 4,285,461 | 8/1981 | Meyers et al. | 206/631 |
| 4,415,084 | 11/1983 | Hauser et al. | 206/470 |
| 4,463,893 | 8/1984 | Brunone et al. | 206/633 |
| 4,568,017 | 2/1986 | Grunert | 206/45.24 |
| 4,784,268 | 11/1988 | Perchak | 206/470 |

*Primary Examiner*—David T. Fidei

*Attorney, Agent, or Firm*—John A. O'Toole

[57] ABSTRACT

Disclosed are containers having a stand feature comprising a tray having a major open end and a defined lid closure for the open end providing the stand feature. The stand feature allows the tray to stand vertically on a sidewall thereby allowing presentation of the package with the lid towards the viewer. The container finds particular suitability for use as a food container for shelf stable packaged food items. The stand feature allows the package to be fabricated without the conventional outer carton or outer shrink wrap film. Also disclosed are package flats for lids having a defined stand forming tab which lids are suitable for use as a closure for trays so as to provide the trays with the present side stand feature.

27 Claims, 4 Drawing Sheets

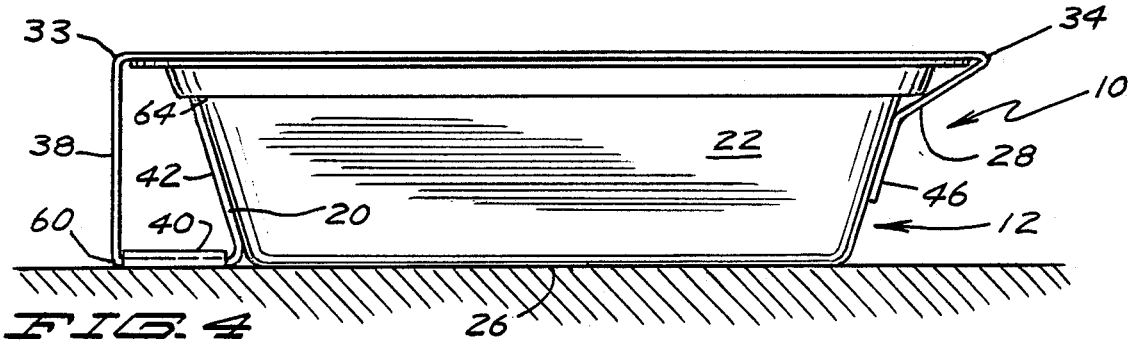
FIG. 4
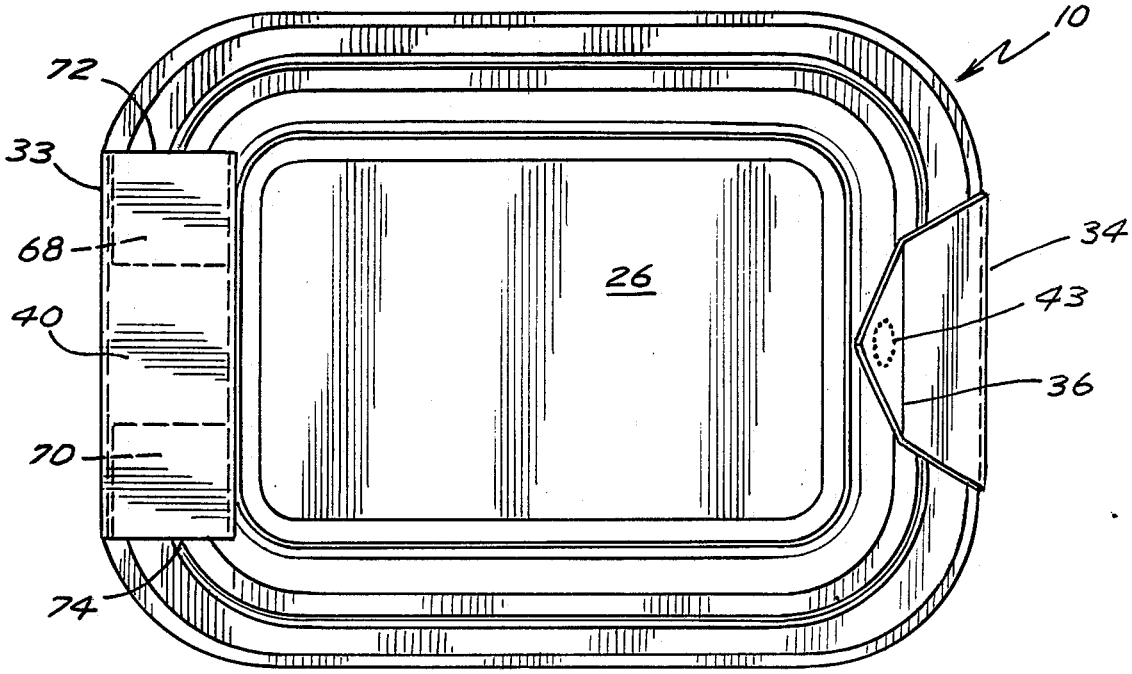
FIG. 5
FIG. 6
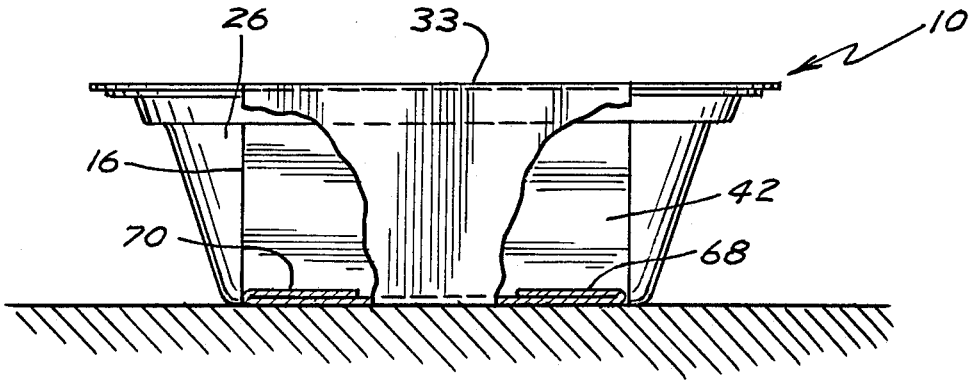

FOOD CONTAINER WITH LID CLOSURE HAVING A STAND FEATURE

FIELD OF THE INVENTION

The present invention relates to containers, to lid closures therefor and to lid closure blanks. More particularly, the present invention provides containers comprising a tray and a particular lid closure for use for packaged foods and which are adapted to stand on one tray side.

BACKGROUND OF THE INVENTION

Containers for a wide variety of food products comprise a tray housing a food portion and having a lid closure sealed to the tray. Such food products may be distributed frozen or may be dry or, if wet, aseptically processed for distribution at room temperature.

More recently, food products adapted to be microwave heated have become especially popular. Frequently, such containers are constructed having a membrane closure sealed to the tray with a removably detachable perforated lid. The consumer removes the lid and membrane seal, replaces the lid and microwave heats the food product. The replaced lid functions as a splatter guard during the microwave heating step. The perforations allow for steam release during the heating step.

While convenient and practical, such containers are almost invariably housed within an outer carton or box and often additionally comprise a shrink wrap film to provide a tamper evident feature and/or to hold the package elements together. The outer carton is typically rectangular and is often adapted to stand on one minor side so as to present a major face outward to the consumer. The outer carton's major face contains graphics and print information designed to attract and appeal to consumers.

While manifestly desirable from a sales standpoint, the outer carton and shrink wrap film elements represent a considerable cost to the overage package system. Moreover, the carton is often times negatively perceived by the consumer as costly and wasteful excess packaging material. Accordingly, it would be desirable to fabricate containers which allow for standing on one minor side to present a major face, e.g., the lid, to the consumer/viewer. Such a construction would allow the graphics to be presented on the lid which comprises the major face. Such a construction would provide the benefit of eliminating the need for the additional external cardboard box housing the container.

While the need for such a container and the advantages to be derived therefrom are clear, the satisfaction of this need is maddeningly complex. The container design necessarily must provide the necessary support. The support must be of sufficient strength to support typical loads occasioned by conventional stacking arrangements. The structure must be easy to open. The structure must comprise elements which themselves are easy to manufacture and to assemble. The package must also stack on its major surfaces during distribution to the food retailer in conventional multiple unit case packing. The Package desirably is tamper evident, i.e., the consumer can determine from visual inspection that the container seal integrity has not been compromised. Of course, each package element is desirably low in cost while highly functional.

Surprisingly, the present invention provides a container design which meets each of these requirements and therefore satisfies the need for an improved food container having a stand feature. The present invention resides in part in a specially defined lid flat adapted to be used as a closure for conventional trays which lid includes a novel stand/support feature.

BRIEF DESCRIPTION OF THE DRAWINGS

FIG. 4 is a side view of the container;

FIG. 5 is a bottom view of the container;

FIG. 6 is an end view of the container;

The foregoing briefly described drawings are for illustrative purposes only and should not be construed to limit the claims.

DESCRIPTION OF THE PREFERRED EMBODIMENTS

Figure 1:
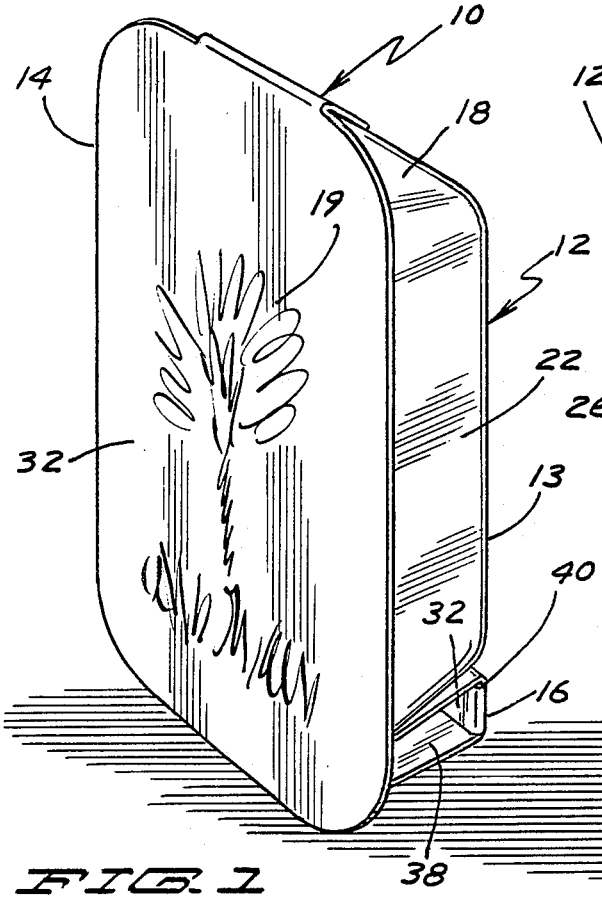
FIG. 1 is a perspective view of an embodiment of the present container presenting the lid or container front face partially to the viewer.

Referring now to the drawings, and in particular to FIG. 1, there is shown a first embodiment of the present food container designated generally by reference numeral 10 having as a distinctive feature an end stand 16. The container 10 can be of any conventional shape depending upon the size, number, and shape of the food items being packaged. If desired, the article 10 can optionally include a conventional overwrap or wrapper (not shown) closely conforming to the shape of the container described below and substantially surrounding and sealing the article. The material from which the overwrap is fabricated can be any conventional packaging material for frozen or shelf stable food items, such as a plastic film or heat oriented polyolefin copolymer having a thickness of about 0.0005 to 0.002 inch. However, it is an advantage of the present container that such conventional overwrap can be eliminated without sacrificing a tamper evidencing feature as described more fully below. More importantly, the present container 10 desirably avoids a conventional, expensive outer box or carton.

In FIG. 1, it can be seen that the container 10 essentially comprises a tray 12 for supporting the item(s) to be packaged and a novel closure lid 14 therefor. The tray 12 is conventional in design, shape and size and can conveniently be constructed or fabricated from plastic, metal, ceramics, or, preferably, pressed paper. The tray 12 has a continuous sidewall 13 for standing thereon. The tray can be of any regular or complex shape. Useful regular shapes, of course, include both those trays which are continuously curved (e.g., ovals or circles) and those having at least one straight side (such as square, triangular, half circle, or preferably rectangular). The rectangular tray 12 depicted shows the continuous sidewall 13 as including an opposed pair of minor sides including upper minor side 18 and lower or bottom minor side 20 and an opposed pair of major sides 22 and 24 (see FIG. 2). Now referring briefly to FIG. 2, it can be seen that the tray 12 additionally includes a rear major surface 26 and an opposed major open face or orifice 27.

Once again referring to FIG. 1 it is seen that the lid 14 overlays the tray open face 27 and thus functions as a removably sealed closure therefor. The lid 14 includes a major face portion or lid panel 32 which conforms to the shape of the open face 27. The lid 14, and especially the lid face panel 32, can conveniently be printed with a variety of graphic material 19 such as pictures, prints, trademarks, directions, nutritional information, etc. Such graphics are conventionally employed on the outer container of a packaged food item.

Now reference is made again to FIG. 2 which shows that the container 10 includes, and the lid 14 additionally comprises, a means for supporting the tray 12 in a vertical position such as the tab stand feature 16. The tray supporting means provides for the tray 12 to rest on a sidewall especially on a retail shelf so as to present forwardly the lid panel 32 to a potential viewer/consumer. The stand feature 16 can include a base panel 38, a rear panel 40, and a support panel 42. As shown, the container's stand feature 16 is integral to the lid 14. Importantly, the stand 16 provides stability both side to side as well as forward and backward and sufficient vertical support to support the filled container's weight even after repeated handling.

Figure 2:
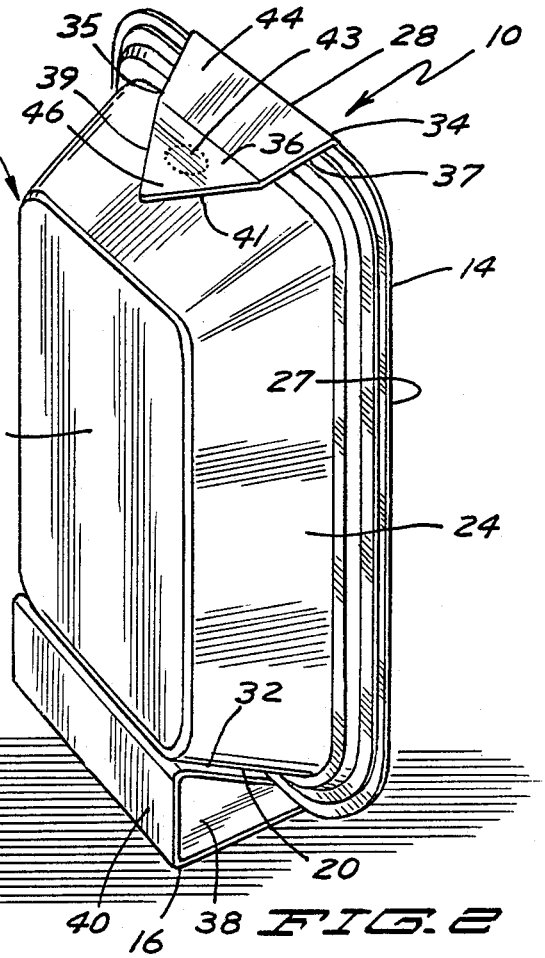
FIG. 2 is a perspective view of the container showing its rear face.

Still referring to FIG. 2, it can be further seen that the container 10 further essentially comprises a means for controllably removing the sealed lid closure 14 from the tray 12, i.e., opening the container 10, which means can include a pull or removal tab 28. In FIG. 2, the container 10 is depicted having a top pull tab, i.e., where the pull tab 28 is positioned at the top of the container 10. As depicted, the pull tab 28 is hingedly connected to the lid face portion 32 along a transverse fold line 34 and thus is an integral part of the lid 14. The pull tab 28 can comprise a first unglued or adhesive free portion 44 conveniently trapezoidal in shape defined by fold line 34 and a fold line 36 and free edges 35 and 37. The pull tab 28 can further include a second portion 46 conveniently triangular defined by fold line 36 and free edges 39 and 41 which also define a tip point 45. The portion 46 is removably adhesively affixed to tray side 18 in a conventional manner such as by adhesion (i.e., employing an adhesive or glue) or by sealing (e.g., the hot melting of a topically applied plastic coating). In the most preferred embodiment, only a limited portion such as under a circular score line 43 (shown in relief), is affixed to the tray sidewall so that opening is very easy.

Figure 3:
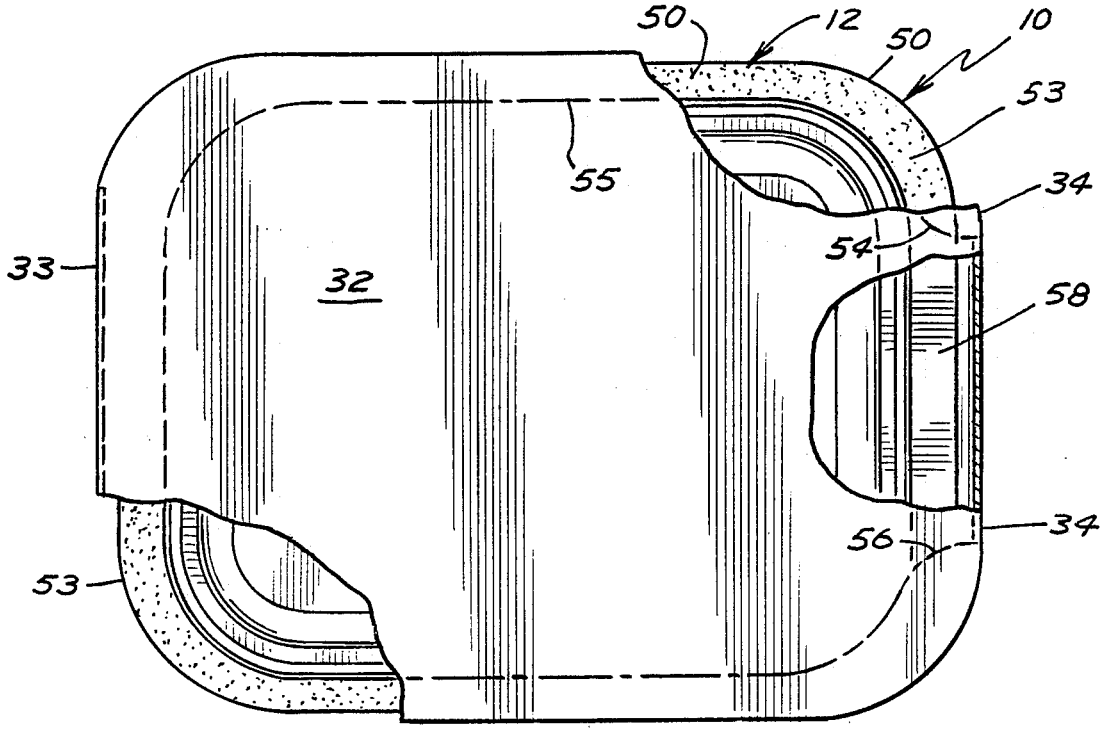
FIG. 3 is a top view of the container with the lid partially cut away.

Referring now to FIG. 3, it can be seen that the particular tray 12 depicted additionally includes, and the tray sidewall is fabricated with, a flange 50 extending completely around the periphery of the open face 27. FIG. 3 further shows that the lid major face 32 can have rounded corners so as to conform to the configuration of the tray 12 which can have rounded corners or in minor variations, sharp corners. In addition to the first transverse fold line 34, the maJor face 32 is further defined by a second transverse fold line 33 along which the base panel 38 (not shown) is hingedly attached.

Still referring to FIG. 3, it can be seen that the container 10, specifically, the controlled opening means, additionally comprises a means for removably adhering the major face portion 32 of the lid 14 to the flange 50 such as a heat activated adhesive 52 or preferably a conventional topically applied plastic coating applied to the inner surface of the lid 14 for hot melt sealing. If an adhesive is employed, the adhesive is applied to substantially all of the flange 50 to define a flange adhesive area 53 so as to Provide a seal-proofed seal. However, in certain embodiments not requiring a seal-proof seal, e.g., where the container houses dry mix pouches, the means for controllably opening the container can additionally include a flange adhesive free portion or area 58 underlying the lid 14 proximate the fold line 34 which remains unsealed.

FIG. 3 further shows that in preferred embodiments, the lid 14 can be fabricated with and the controlled opening means can further comprise a peripheral score line 55 (shown in relief) on the inner surface of the lid's maJor surface positioned proximately overlaying the inner edge 57 of flange 50 terminating at one end at an angled score line 54 which extends to the one end of fold line 34 and terminating at its other end at a second angled score line 56 which itself extends to the other end of fold line 34. Each angled score line 54 and 56 are also on the inner surface. The term "score line" (or sometimes equivalently "cut score line" in the art) is used in a conventional sense to refer to a cut in a surface which penetrates about 50% through the depth of that surface. The term "cut line" is used herein to refer to a cut in a surface which completely penetrates through that surface. Score lines 54 and 56 are in alignment with free edges 37 and 35, respectively. The adhesive free portion 58 desirably extends at least along that portion of flange 50 between intermediate score lines 54 and 56. In this embodiment the adhesive free area 58 and the cut lines 54 and 56 collectively comprise a "score cut" controlled opening feature which facilitates ease of opening of the container 10 by controlling the tearing back of the lid 14 and thereby the adhesive bond between lid 14 and the flange 50.

Referring now back briefly to FIG. 2, even though the container 10 in this particular embodiment includes the unsealed portion 58, the container 10 is considered to have sufficient seal integrity to provide a tamper proof seal since the unsealed portion 58 is inaccessible due to the overlapping positioning of the lid free portion 44 (not shown) by panel 44.

Reference is now made briefly to FIG. 4 which better shows the stand feature 16 and wherein it can be seen that stand rear panel 40 is in the same plane as the tray rear face 26 which facilitates packing the container 10 when horizontally oriented, i.e., on its rear face 26, such as in cases for distribution to food retailers. Rear panel 40 and base panel are each partially defined by a common transverse fold line.

Also, FIG. 4 further depicts that support panel 42 is in face to face confronting relationship with the tray sidewall 13, such as tray minor side 20 and at least a Portion of which is adhered to the sidewall 13 such as with adhesive (not shown). In the most preferred embodiments, it is an important feature of the present invention that one or more stand support panels are adhesively attached to the tray sidewall 13 rather than exclusively attached to the tray back surface 26. Unfortunately, when conventional hot melt glue is employed, upon microwave heating, stand configurations having flaps attached exclusively to the tray back 26 tend to loosen due to the temperatures reached and then possibly to completely detach. Such detachment of the lid closure 14 from the tray 12 is aesthetically undesirable giving the erroneous but suggestive appearance of poor design or construction.

In FIG. 4 it can be seen that in this embodiment, optionally the tray 12 can further be fabricated with a step flange defining an inner peripheral shoulder 64. The support panel 42 extends sufficiently to include a transverse free edge 66 which rests against shoulder 64 which feature Provides additional support against forward/backward rocking. It will be appreciated that the present lid stand can be used with common, simple flange trays (i.e., not having the shoulder 64) as well as the step flange tray depicted herein.

Referring now briefly to FIG. 5 it can be seen that in the most preferred embodiment the stand feature 16 additionally comprises a single opposed pair of lateral support flaps inwardly folded (shown in relief) 68 and 70. Flap 68 is inwardly folded and hingedly connected to rear panel member 40 along the longitudinally extending fold line 72. Similarly, stay flap 70 is inwardly folded and is hingedly connected to rear panel 40 along fold line 74. Importantly, stay flaps 68 and 70 assist prevention of buckling of panel 40 from compression loading occasioned by the standing of the container 10 on a minor side. Stay flaps 68 and 70 are affixed, e.g., glued, to panel 40 so as to maintain their position which is important to providing the support function. It can further be seen that the stand rear panel 40 is articulated or hingedly attached along and defined in part by fold lines 39 and further includes an opposed pair of spaced apart longitudinally extending free edges 76 and 78.

Referring now very briefly to FIG. 6, the inwardly folded position of stay flaps 68 and 70 can clearly be seen. The stand feature 16 can be seen to have a width approximately equal to the width of the tray rear face 26. Of course, other articles within the scope of the present invention can be constructed with wider stand features if desired such as for heavier products or for a container having a substantially wider open face than rear face.

Figure 7:
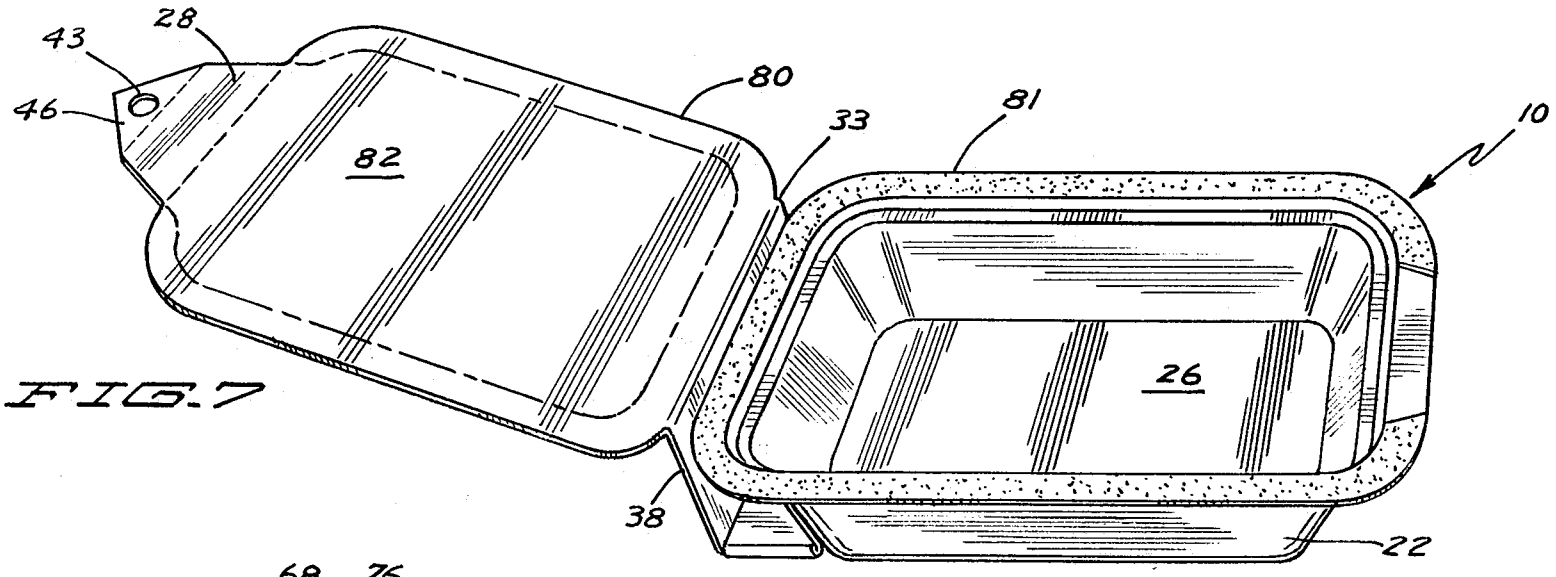
FIG. 7 is a perspective view of the container showing the lid in an open position after unsealing the container.
Figure 9:
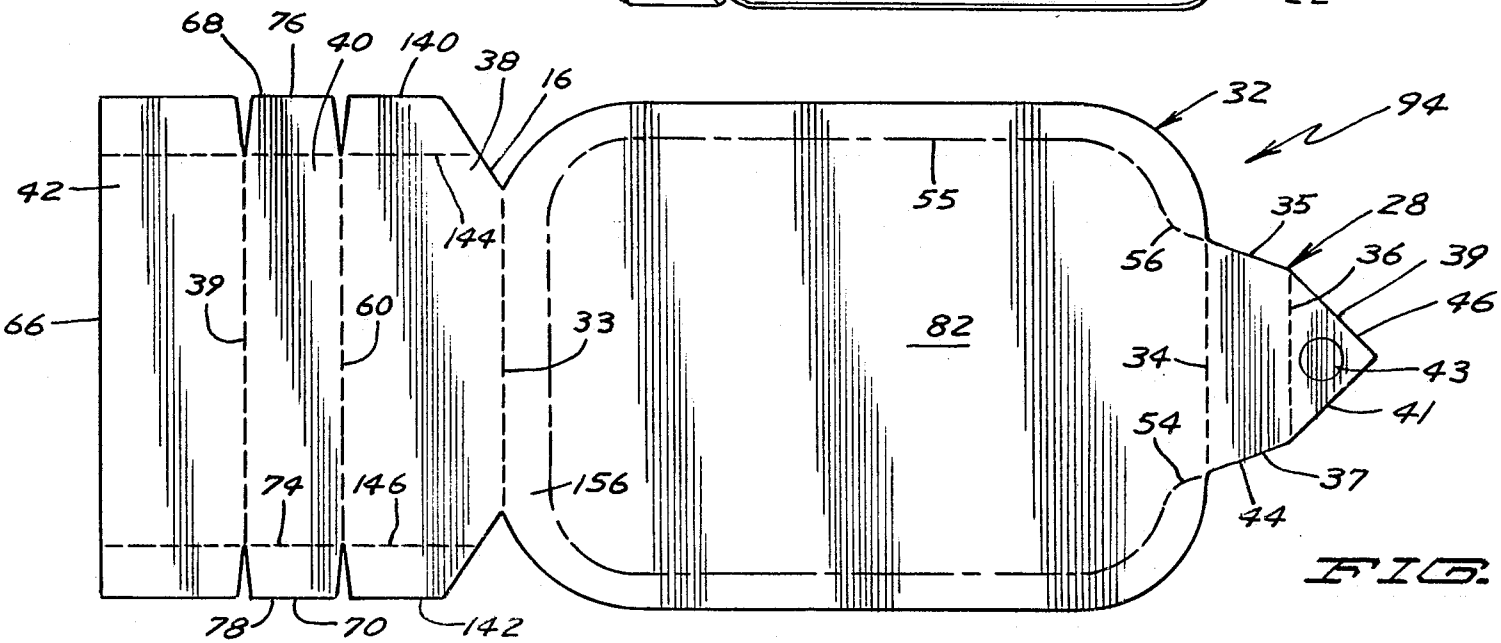
FIG. 9 is a plan view of a package flat lid which is a second variation of the embodiment depicted in FIG. 8 having an additional two pairs of support flaps.

Reference now is made to FIG. 7 which shows the container 10 after the lid 14 has been controllably opened or unsealed exposing a lid panel interior major surface 82 of the lid face portion 32. As the lid 14 is controllably unsealed or pulled back to unseal the container 10, the lid 14 generally is articulated along the transverse fold line 33 or an informal fold line proximate thereto which might be formed upon opening. The container 10 depicted in FIG. 7 is shown without a charge of food. However, if the container 10 does contain a food portion or a food portion is subsequently added to the container 10, then the food containing container 10 can then be heated such as in a microwave oven for an appropriate time. The lid 14 is articulated back to a closed but unsealed position (not shown). In this position, the lid 14 acts as a cover or splatter guard during the microwave heating step. Conveniently, in its unsealed condition, the lid 14 allows for steam escape during microwave heating of the foodstuff.

In FIG. 7, it can be seen that in this particular embodiment as the lid 14 is removed and unsealed, a Peripheral portion of the lid inner surface 82 which was adhesively sealed to the flange 50 partially topically delaminates removing a layer to define a delaminated area 80 extending outwardly from the peripheral score line 55. The topical delamination is facilitated by, and its extent is limited by the peripheral score line 55. FIG. 7 further shows a corresponding layer 81 remaining on the flange 50 corresponding in size and extent to the glue portion 53.

In certain embodiments not illustrated but nonetheless well within the scope of the present invention, the package 10 does not comprise an adhesive-free portion 58, but rather, the flange 50 has the adhesive means 52 substantially completely over its surface area to provide a seal-proof closure. Such a construction is desired where the container is used, for example, to contain an aseptically processed foodstuff such as a high water activity material such as a stew or meal entree. Those embodiments wherein the container 10 does comprise the glue free portion 58 might include, for example, wherein the container 10 is used to house one or more packets in or internesting trays for packaged dry food items (e.g., a first packet of seasoning dried rice and an associated tray and a second packet of aseptic meat sauce).

Figure 8:
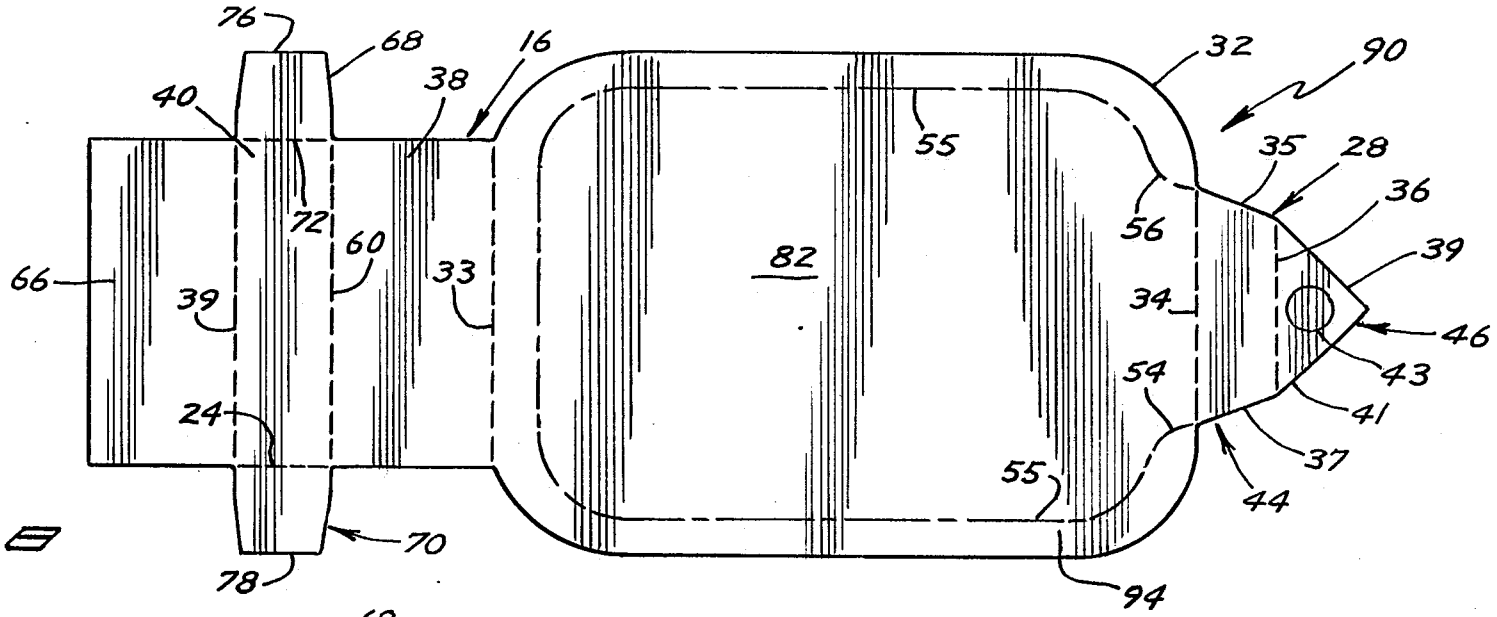
FIG. 8 is a plan view of the inner surfaces of a lid blank for forming one embodiment of the present lid closure.

Reference now is made to FIG. 8 which shows a lid blank 90 for forming the lid 14. The blank 90 can be fabricated out of a single piece of conventional packaging material such as bleached kraft, white-coated newsboard, chipboard or other flexible materials well known in the carton art. The blank 90 is shown with the inner surface 82 being uppermost which later becomes the inside of the container 10. Commonly, the outer surface (not shown) is white-coated or clay-coated and displays the carton's exterior graphics as described above. The blank 90 depicted includes contiguously an upper pull tab panel 28, a cover or major face panel 32 and a stand panel 16. These panels are hingedly connected along transverse fold lines 34 and 33 respectively. Pull tab panel 28 itself comprises a trapezoidal panel 44 having free edges 35 and 37 and also is hingedly connected to a triangular or point panel 46 along a transverse fold line 36. The point panel has free edges 39 and 41. The point panel 46 can have a circular score line 43 which facilitates its detachment from the tray by facilitating topical delamination. The stand panel 16 itself comprises a base panel 38 and a back or rear panel 40 hingedly articulated or foldably joined along a common transverse fold line 60 as well as a support panel 42 hingedly articulated along a common fold line to the rear panel 40. The rear panel 40 further comprises a first pair of opposed inwardly foldable stay flaps 68 and 70 each hingedly connected or articulated along longitudinally extending fold lines 72 and 74, respectively. Finally, FIG. 8 shows that the major face panel 32 includes a peripheral score line 55 on the inner surface 82 except proximate fold line 34 where the score line terminates at one end at an angled score line 56 proximate free edge 35 and at its other end with a second angled score line 54 proximate free edge 37.

Figure 10:
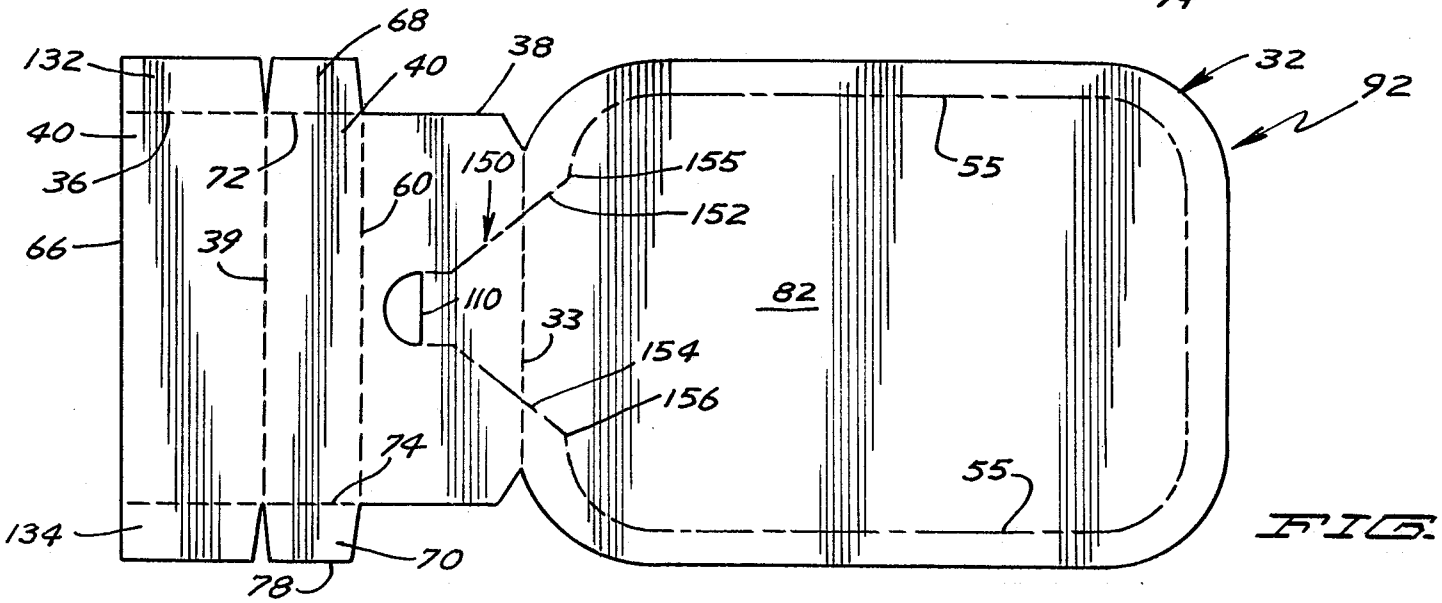
FIG. 10 is a plan view of a third package flat which is a third variation of the embodiment depicted in FIG. 8 having only one additional pair of stay flaps.

Reference is now made to FIG. 10 which shows a package lid flat 92 substantially similar to package lid flat 90 but additionally comprising an additional pair of support flaps and having a lower positioned pull tab formed as part of the stand. First, specifically flat 92 additionally comprises a second pair of opposed inwardly foldable support flaps 132 and 134 or base panel support flaps hingedly connected to the support panel 42 along an opposed pair of longitudinally extending fold lines 136 and 138 respectively. Close examination of FIG. 10 shows that in this version, the stand panel is wider in a transverse direction (i.e., parallel to fold line 33) relative to the base panel depicted in FIG. 8. The panel lid blank or flat 130 has a "bottom" pull tab feature 150 defined by a thumbhole in the base panel 110 formed by an appropriately shaped cut line as well as by a pair of angled score lines or perforation lines 152 and 154 extending therefrom to meet at a first end 155 of the peripheral score line 55 and at a second end 156 of the peripheral score line proximate fold line 33. The skilled artisan will appreciate that these as well as other minor variations in construction detail are within the scope of the present invention.

A brief reference is made to FIG. 10 which shows a package flap substantially identical to that shown in FIG. 8 and described above except for the presence of a second set of lateral support flaps equivalent to support flaps 132 and 134. This third lid flat 94 also additionally comprises a third pair of opposed inwardly foldable stay flaps 140 and 142 or support panel stay flaps hingedly connected to the base panel 38 along an opposed pair of longitudinally extending fold lines 144 and 146, respectively.

INDUSTRIAL APPLICABILITY

The present article finds particular suitability for use in the paper packaging industry and especially for the packaged foods trade. The present containers find utility for the packaging of both frozen and shelf stable food items. It will be appreciated, however, that the present containers can also be used as a package for a wide variety of packaged items which are presently packaged with an outer carton.

It should be further understood that the foregoing description of the invention is intended merely to be illustrative thereof and that the invention is not confined to the construction and arrangement of parts herein illustrated and described, but embraces all such modified forms thereof as come within the scope of the of the following claims.

What is claimed is:

1. A container for a packaged item adapted to stand on its sidewall in a vertically aligned position on a shelf thereby allowing presentation of a major face to the consumer without requiring an outer carton and which subsequent to opening can be partially reclosed, comprising:

A. a tray for supporting the item having a rear major surface, an open major face opposite the rear major surface and a continuous sidewall having a top edge B. a lid closure fabricated from a single flexible material piece having a lid panel having an outside and inside major surface and upper and lower ends overlaying the open face and extending over the top edge surface, means for supporting the tray in said vertically aligned position, said means being integrally connected to said lid panel proximate the sidewall, said lid panel being hingedly connected to the support means, adhesive means for releasably attaching said lid panel to the top edge surface of the tray, a means for controllably opening the lid closure, wherein the means for supporting the tray, the plurality of panels includes a base panel hingedly connected to the lid panel along a first common transverse fold line and wherein the base panel is in a plane perpendicular to the plane of the lid panel, a rear panel hingedly connected to the base panel along a second common transverse fold line and wherein the rear panel is in the plane as the tray rear face, and at least one support panel hingedly connected to the rear panel along a third common fold line, said support panel having at least a portion being adhesively secured to the outside of the tray sidewall.

2. The container of claim 1 wherein the first transverse fold line is proximate the outer edge of the tray flange, and wherein the means for controllably opening the lid closure includes a pull tab hingedly connected to the lid panel.

3. The container of claim 2 wherein the pull tab is positioned at the upper end of the lid face panel and wherein the top edge surface is a flange.

4. The container of claim 3 wherein the pull tab has a portion removably adhesively attached to the tray sidewall and is connected to the lid panel along a fourth common, transverse fold line.

5. The container of claim 4 wherein the means for controllably opening the lid closure further includes a first peripheral score line on the inner surface of the inside maJor surface of the lid face panel proximate the inner edge of the tray flange.

6. The container of claim 5 wherein the means for controllably opening the lid closure further includes an adhesive free flange portion proximate the pull tab.

7. The container of claim 1, 2, 3, 4, 5, or 6 wherein the tray has a continuously curved sidewall.

8. The container of claim 1, 2, 3, 4, or 5 wherein the tray has a sidewall having at least a portion which is straight.

9. The container of claim 6 wherein the tray has a sidewall having at least a portion of which is straight.

10. The container of claim 9 wherein the support panel is adhesively affixed to the straight sidewall portion.

11. The container of claim 10 wherein the second common fold line is a transverse fold line.

12. The container of claim 11 wherein the stand tab additionally comprises an opposed pair of support flaps, one of which is hingedly connected to the rear panel along a common fold line and the other of which is hingedly connected to the opposite end of the rear panel along a fifth common fold line and wherein the support flaps are inwardly folded and adhesively bonded to the rear panel.

13. The container of claim 2 wherein the pull tab is positioned at the lower end of the lid face panel.

14. The container of claim 13 wherein the means for controllably opening the lid closure further includes a first peripheral score line on the inner surface of the inside major surface of the lid face panel proximate the inner edge of the tray flange, and wherein the pull tab is defined by a thumbhole in the base panel and a pair of angled score lines in the base panel extending from the thumbhole to the peripheral score line.

15. The container of claim 14 wherein the means for controllably opening the lid closure further includes an adhesive free flange portion proximate the pull tab.

16. The container of claim 15 wherein the tray has a continuously curved sidewall.

17. The container of claim 16 wherein the tray has a sidewall having at least a portion of which is straight.

18. The container of claim 17 wherein the support panel is adhesively affixed to the straight wall portion.

19. A one-piece package blank for a package lid useful as a lid closure for an open faced tray having a sidewall fabricated with a peripheral flange and which supports the tray in a vertical position, comprising:

A. a first major face panel for overlaying the tray open face having inner and outer major surfaces and first and second ends:

B. a stand tab hingedly connected to the first end of the face panel along a first common fold line, said stand tab comprising a base panel hingedly connected to the face panel along the first fold line, a rear panel hingedly connected to the base panel along a second common fold line, at least one support panel hingedly connected to the rear panel along a third common fold line; and C. a pull tab hingedly connected to the second end of the face panel along a fourth, transverse common fold line.

20. The package blank of claim 19 wherein the face panel has a peripheral score line on the inner major surface.

21. The package blank of claim 20 wherein the third common fold line is a transverse fold line.

22. The package blank of claim 21 wherein the rear panel has an opposed first pair of lateral support flaps inwardly foldable hingedly connected along first and second fold lines.

23. The package blank of claim 22 wherein the base panel has an opposed second pair of lateral support flaps inwardly foldable hingedly connected along a third and fourth longitudinally extending fold line.

24. A one-piece package blank for a package lid useful as a lid closure for an open faced tray having a sidewall fabricated with a peripheral flange and which supports the tray in a vertical position, comprising:

A. a first major face panel for overlaying the tray open face having inner and outer major surfaces and first and second ends;

B. a stand tab hingedly connected to the first end of the face panel along a first common transverse fold line, said stand tab comprising a base panel hingedly connected to the face panel along the first transverse fold line, a rear panel hingedly connected to the base panel along a second common fold line, at least one support panel hingedly connected to the rear panel along a third common fold line; and C. a pull tab hingedly connected to the second end of the face panel along a fourth, transverse common fold line.

25. The package blank of claim 24 wherein the face panel has a peripheral score line on the inner major surface.

26. The package blank of claim 25 wherein the third common fold line is a transverse fold line.

27. The package blank of claim 26 wherein the rear panel has an opposed first pair of lateral support flaps inwardly foldable hingedly connected along first and second longitudinally extending fold lines.

* * * * *